US012565992B2

(12) United States Patent
Lu et al.

(10) Patent No.: US 12,565,992 B2
(45) Date of Patent: Mar. 3, 2026

(54) ANTI-BACKFLOW PREMIXING DEVICE AND FUEL GAS WATER HEATER

(71) Applicant: GUANGDONG VANWARD NEW ELECTRIC CO., LTD., Foshan (CN)

(72) Inventors: Chupeng Lu, Foshan (CN); Tongji Pan, Foshan (CN); Luobiao Li, Foshan (CN); Shangbing Zhang, Foshan (CN); Huaping Zhang, Foshan (CN); Zelin Pan, Foshan (CN)

(73) Assignee: GUANGDONG VANWARD NEW ELECTRIC CO., LTD., Foshan (CN)

( * ) Notice: Subject to any disclaimer, the term of this patent is extended or adjusted under 35 U.S.C. 154(b) by 605 days.

(21) Appl. No.: 18/016,362

(22) PCT Filed: Jul. 16, 2021

(86) PCT No.: PCT/CN2021/106903
§ 371 (c)(1),
(2) Date: Jan. 16, 2023

(87) PCT Pub. No.: WO2022/012685
PCT Pub. Date: Jan. 20, 2022

(65) Prior Publication Data

US 2023/0272907 A1 Aug. 31, 2023

(30) Foreign Application Priority Data

Jul. 16, 2020 (CN) ..... 202010686174.3

(51) Int. Cl.
*F23D 14/82* (2006.01)
*F23D 14/02* (2006.01)
(Continued)

(52) U.S. Cl.
CPC ..... *F23D 14/825* (2013.01); *F23D 14/02* (2013.01); *F23D 14/04* (2013.01); *F23D 14/60* (2013.01);
(Continued)

(58) Field of Classification Search
CPC ..... F23D 14/825; F23D 14/02; F23D 14/04; F23D 14/60; F23D 14/62; F23D 14/70;
(Continued)

(56) References Cited

U.S. PATENT DOCUMENTS 4,465,456 A * 8/1984 Hynek ..... F23N 1/025 137/98
6,604,938 B1 * 8/2003 Blaauwwiekel ..... F23D 14/04 137/895
(Continued)

FOREIGN PATENT DOCUMENTS

CN 201265960 Y 7/2009
CN 201875898 U 6/2011
(Continued)

OTHER PUBLICATIONS

Emerson_Exchange_how_does_a_direct_operated_pressure_regulator_work_2017.pdf (Year: 2017).*
(Continued)

*Primary Examiner* — Steven S Anderson, II
*Assistant Examiner* — Kurt J Wolford
(74) *Attorney, Agent, or Firm* — Kilpatrick Townsend & Stockton LLP

(57) ABSTRACT

Disclosed are an anti-backflow premixing device and a fuel gas water heater, where the anti- backflow premixing device includes a casing body, a premixing cavity is provided in the casing body, and the premixing cavity includes a gas outlet pathway; a baffle, the baffle is connected in the casing body, the baffle has a first position and a second position, the baffle
(Continued)

can continuously move between the first position and the second position, the baffle obstructs the gas outlet pathway of the premixing cavity when at the first position, and the gas outlet pathway gradually opens when the baffle is moved from the first position to the second position; and a fuel gas passage, the fuel gas passage and the premixing cavity being in communication.

11 Claims, 10 Drawing Sheets

(51) Int. Cl.

| | |
|---|---|
| ***F23D 14/04*** | (2006.01) |
| ***F23D 14/60*** | (2006.01) |
| ***F23D 14/62*** | (2006.01) |
| ***F23D 14/70*** | (2006.01) |
| ***F23N 1/02*** | (2006.01) |
| *F23D 14/64* | (2006.01) |
| *F23D 23/00* | (2006.01) |
| *F24H 1/00* | (2022.01) |

(52) U.S. Cl.
CPC ..... *F23D 14/62* (2013.01); *F23D 14/70* (2013.01); *F23N 1/027* (2013.01); *F23D 14/64* (2013.01); *F23D 23/00* (2013.01); *F23D 2203/007* (2013.01); *F23D 2209/10* (2013.01); *F24H 1/0027* (2013.01)

(58) Field of Classification Search
CPC .... F23D 14/64; F23D 23/00; F23D 2203/007; F23D 2209/10; F23N 1/027; F24H 1/0027
See application file for complete search history.

(56) References Cited

U.S. PATENT DOCUMENTS

| | | | | |
|---|---|---|---|---|
| 9,523,515 | B2 * | 12/2016 | Park | F23D 14/62 |
| 2015/0050608 | A1 * | 2/2015 | Min | F23D 14/02 431/354 |
| 2021/0041100 | A1 * | 2/2021 | Noritake | F23D 14/60 |
| 2021/0123598 | A1 * | 4/2021 | Planer | F23L 13/02 |

FOREIGN PATENT DOCUMENTS

| | | | |
|---|---|---|---|
| CN | 201992830 | U | 9/2011 |
| CN | 103732996 | A | 4/2014 |
| CN | 103742915 | A | 4/2014 |
| CN | 104094058 | A | 10/2014 |
| CN | 104981657 | A | 10/2015 |
| CN | 204880728 | U | 12/2015 |
| CN | 104114945 | B | 6/2016 |
| CN | 104094058 | B | 10/2016 |
| CN | 104114946 | B | 11/2016 |
| CN | 104838207 | B | 11/2016 |
| CN | 205825438 | U | 12/2016 |
| CN | 206113360 | U | 4/2017 |
| CN | 104246369 | B | 1/2018 |
| CN | 107957068 | A | 4/2018 |
| CN | 109579280 | A | 4/2019 |
| CN | 110068012 | A | 7/2019 |
| CN | 209325780 | U | 8/2019 |
| CN | 209605156 | U | 11/2019 |
| CN | 110595066 | A | 12/2019 |
| CN | 210035881 | U | 2/2020 |
| CN | 210107388 | U | 2/2020 |
| CN | 110906333 | A | 3/2020 |
| CN | 210241994 | U | 4/2020 |
| CN | 210800144 | U | 6/2020 |
| CN | 210800148 | U | 6/2020 |
| CN | 111828977 | A | 10/2020 |
| KR | 20030026601 | A | 4/2003 |

OTHER PUBLICATIONS

PIF_everything_you_need_to_know_about_gas_solenoid_valves_2018.pdf (Year: 2018).*

ISA State Intellectual Property Office of the People's Republic of China, International Search Report Issued in Application No. PCT/CN2021/106903, Sep. 28, 2021, WIPO, 4 pages.

ISA State Intellectual Property Office of the People's Republic of China, Written Opinion of the International Searching Authority Issued in Application No. PCT/CN2021/106903, Sep. 28, 2021, WIPO, 4 pages.

* cited by examiner

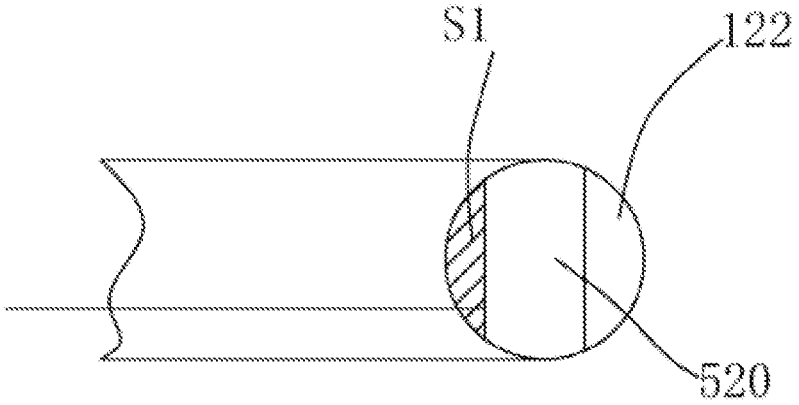
FIG. 10-A
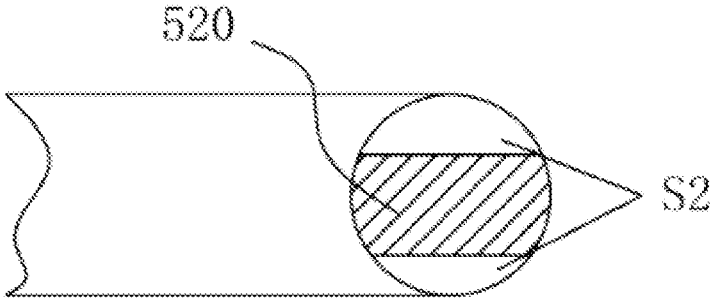
FIG. 10-B
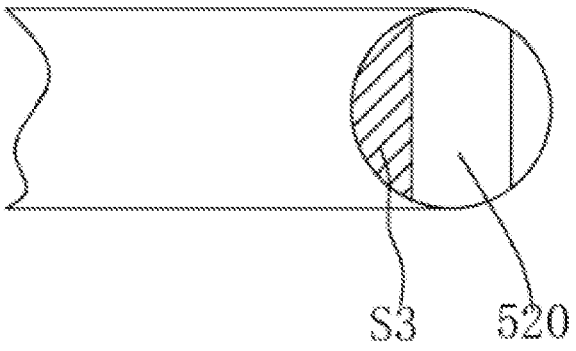
FIG. 10-C

ANTI-BACKFLOW PREMIXING DEVICE AND FUEL GAS WATER HEATER

CROSS-REFERENCE TO RELATED APPLICATIONS

This application is an U.S. national phase application under 35 U.S.C. § 371 based upon international patent application No. PCT/CN2021/106903, filed on Jul. 16, 2021, which itself claims priority to Chinese patent application No. 2020106861743 filed on Jul. 16, 2020. The contents of the above identified applications are hereby incorporated herein in their entireties by reference.

FIELD

The present disclosure relates to the field of gas water heaters, in particular to a mixer for fully premixing air and gas in a gas water heater.

BACKGROUND

In gas water heaters, gas combustion is divided into diffusion combustion, partial premixed combustion (atmospheric combustion) and full premixed combustion. Premixed combustion refers to a process in which air and gas are fully mixed in advance according to a proportion to form a premixed gas, which is then ignited and burned in a burner. Premixed combustion generally occurs in a relatively closed system. Compared with diffusion combustion, premixed combustion has faster flame propagation speed, higher combustion temperature and better ductility because gas and air (oxygen) are fully mixed before combustion, so it has a good application prospect in the gas water heaters.

In winter in the north, the outdoor temperature is generally below zero, while the indoor temperature is above 20 degrees. Therefore, the temperature difference formed makes the outdoor cold air easily enter the water heater through a smoke exhaust channel of the gas water heater, to freeze a heat exchanger of the water heater (the water freezes and a water pipe is expanded), a non-condensing machine generally has an anti-backflow device at a smoke exhaust port of the water heater, but most of the fully premixed combustion water heaters has condensers. If the anti-backflow device is provided to the smoke exhaust port, it will usually be frozen by frozen condensed water and cannot be opened, which will cause the water heater to fail to work.

SUMMARY

Embodiments of the present disclosure provide an anti-backflow premixer to solve one or more problems in the related art, and at least provide a beneficial option or create conditions.

The solution of the present disclosure to solve the problem is:

An anti-backflow premixer includes: a housing provided with a premixing chamber that extends through the housing, the premixing chamber including an air outlet passage; a baffle connected to the housing, and the baffle has a first position and a second position, and the baffle is capable of moving continuously between the first position and the second position, the baffle blocks the air outlet passage of the premix chamber when the baffle is in the first position, when the baffle moves from the first position to the second position, an opening of the air outlet passage gradually increases; and a gas channel being in communication with the premixing chamber.

The beneficial effects of the present disclosure are: the present disclosure adds a baffle to the premixer, when not working, the baffle is configured to completely seal the premixing chamber, and an air flow cannot flow back and prevent a cold air from flowing back into a heat exchanger and causing damage, and also prevents high-temperature flue gas from flowing back into a fan and a water heater, protects a normal use of a product, increases its service life, and greatly improves product safety. While working, the air and gas in the water heater maintain a stable air-fuel ratio in a predetermined load range through a gradual movement of the baffle, and the gas can be stably and completely burned in the water heater.

As a further improvement of the above embodiments, the baffle blocks the air outlet passage using its own gravity, the housing is provided with an inclined platform surface on a peripheral wall of the premixing chamber, when the baffle is in the first position, one end of the baffle is hinged to the housing, and the other end thereof is inclined downward and abuts against the platform surface. The baffle utilizes its own gravity to block the baffle. When working, since the water heater is provided with a fan, a negative pressure generated by the fan overcomes the gravity of the baffle to open the baffle, when the water heater is not working, the fan stops running, the baffle returns to the first position under the action of its own gravity. The inclined platform surface is equivalent to a limiting base, and the baffle has an inclined initial state, which is convenient for the baffle to be opened later during work.

As a further improvement of the above embodiments, one end of the baffle is hinged to the housing, a resilient element is provided between the baffle and the housing, the resilient element exerts a force to the baffle to move to the first position. The baffle, in addition to being restored to the first position by gravity, may also be restored to its position by the resilient element. One end of the resilient element abuts against the baffle and the other end abuts against the housing, the abuts against forces the shutter to move to the first position.

As a further improvement of the above embodiments, the resilient element is a compression spring, one end of the resilient element is adjustable connected to the housing, and the other end thereof abuts against the baffle. For example, a threaded element can be provided in the housing, the threaded element is threaded into the housing, one end of the threaded element abuts against the compression spring. By adjusting an initial position of the threaded element, a precompression force of the resilient element can be adjusted, and an opening force of the baffle can be adjusted.

As a further improvement of the above embodiments, the premixing chamber is further provided with a cover plate, the cover plate is inclined downward from rear to front, an upper end of the cover plate is hinged to an inner surface of the housing, the cover plate covers the gas channel under an action of its own weight. By adding the cover plate, the gas outlet is sealed and cannot discharge gas when the baffle is not opened, eliminating a risk of direct gas discharge due to mis-operation or failure of the gas valve, and improving product safety.

As a further improvement of the above embodiments, the gas channel includes a gas outlet, when the baffle is in the first position, the gas outlet abuts against the baffle. The gas outlet and the gas outlet passage are simultaneously sealed by the baffle, and a structure of the premixer is simpler.

As a further improvement of the above embodiments, two premixing chambers are provided, the two premixing chambers are arranged side by side left and right, both of the premixing chambers are venturi tubes, and both of the premixing chambers are provided with the baffles. Both of the premixing chambers arranged side by side have the gas outlets. When working, at the same fan speed, an adjustment range of product's thermal load can be increased, a range of temperature adjustment can be increased, a comfort of the product can be improved, especially for the product with a heavy load.

As a further improvement of the above embodiments, the two premixing chambers are respectively a first premixing chamber and a second premixing chamber, a minimum cross-sectional area of the first premixing chamber is greater than a minimum cross-sectional area of the second premixing chamber. The cross-sectional areas of the two premixing chambers are different, which can further increase a thermal load adjustment ratio of the water heater.

As a further improvement of the above embodiments, the two baffles are respectively a first baffle and a second baffle, the first baffle is mounted in the first premixing chamber, the second baffle is mounted in the second premixing chamber, a driven force of the first baffle is greater than a driven force of the second baffle when moving from the first position to the second position. For the baffles in the two or more premixing chambers, when one of the baffles has a small mass m, or a force-bearing area S of the baffle is great, or a value of an acute angle B is small, its driven force is small, when working, under an action of the same fan speed, it will be opened first, the other will not be opened, forming a segmented intake combustion, which can increase the adjustment range of the product's thermal load, increase the range of the temperature adjustment, and improve the comfort of the product, especially for the product with the heavy load.

As a further improvement of the above embodiments, the gas channel is provided with an adjusting device, and the adjusting device is configured to adjust a minimum flow area of the gas channel. The adjusting device is provided in the gas channel, which is conducive to a unified production of large quantities of products, improving production efficiency, and reducing product costs. Only need to replace the adjusting device or some parts, it can be adjusted to products with different gas sources, which is more conducive to the replacement of gas sources for sold products. It can also adapt to larger changes of the same gas source through fine-tuning. The adjustment device can be equipped with nozzles of different sizes, different angles to produce objects with different areas, different depths to produce objects with different cross-sectional areas, etc. An original air path can be designed according to the air source with a low Wobbe number, and when changing to a gas source with a high Wobbe number, add parts to reduce the area of the gas passage, etc.

As a further improvement of the above embodiments, the adjusting device includes a connecting portion and an adjusting portion connected to each other, the connecting portion is located on a peripheral wall of the gas channel and is rotatably connected to the housing, the adjusting portion is at least partially located in the gas channel, and the adjusting portion changes the minimum flow area of the gas channel with a rotation of the connecting portion.

As a further improvement of the above embodiments, the gas channel includes a first adjusting section and a second adjusting section that are connected in series in sequence, the first adjusting section and the second adjusting section are perpendicular to each other, the connecting portion is provided on a peripheral wall of the first adjusting section and is rotatably connected to the housing, and the adjusting portion is inserted into the second adjusting section. The two adjusting devices provided in the two gas passages are arranged side by side. The two adjusting devices are arranged side by side for easy adjustment on the same side.

As a further improvement of the above embodiments, the gas channel is shaped as a circular tube, the adjusting portion is located at a junction of the first adjusting section and the second adjusting section, the adjusting portion is block-shaped, a cross-sectional area of the adjusting portion is adapted to a pipe diameter of the second adjusting section, and the adjusting portion is arranged eccentrically on the connecting portion. In this way, by rotating the connecting portion, the connecting portion can be respectively located at three different positions of 0°, 90° and 180°. In the three different positions, the adjusting portion can achieve three different adjustments to the minimum flow area of the gas channel, and three adjustment effects of the flow area can be achieved.

As a further improvement of the above embodiments, the adjusting device further includes an electric adjustment portion, the electric adjusting portion is configured to controllably drive the connecting portion;

or, the adjusting device further includes a manual adjustment portion, the manual adjustment portion is at least partially exposed outside the housing, the manual adjusting portion is configured to drive the connecting portion.

At the same time, the present disclosure further provides a gas water heater having the above-mentioned anti-backflow premixer.

BRIEF DESCRIPTION OF THE DRAWINGS

In order to more clearly illustrate the embodiments in the embodiments of the present disclosure, the following will briefly describe the drawings that need to be used in the description of the embodiments will be briefly described below. Apparently, the described drawings are only some embodiments of the present disclosure, not all embodiments.

FIG. 10-A is a schematic view of the adjusting device of the present disclosure in a first state.

FIG. 10-B is a schematic view of the adjusting device of the present disclosure in a second state.

FIG. 10-C is a schematic view of the adjusting device of the present disclosure in a third state.

DETAILED DESCRIPTION OF THE EMBODIMENTS

Figure 1:
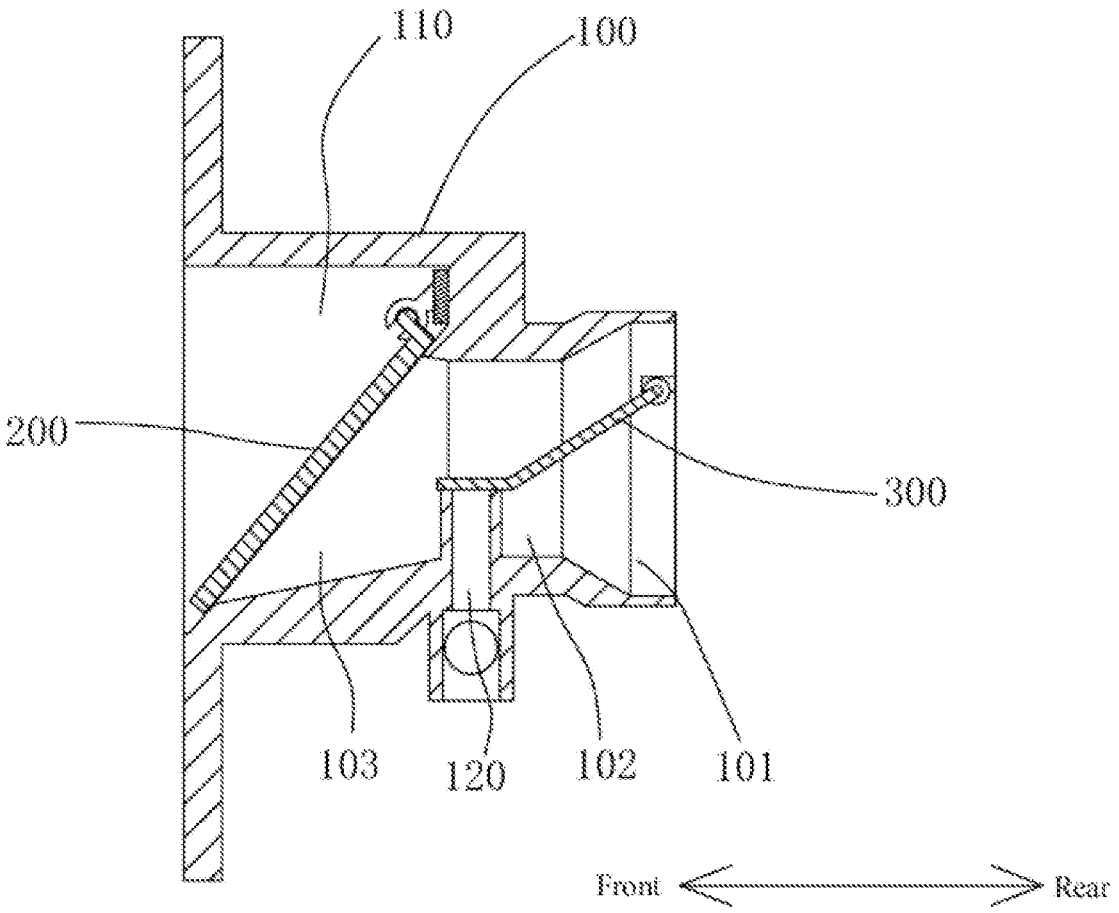
FIG. 1 is a schematic view of a first embodiment of the present disclosure.

Embodiments of the present disclosure will be clearly and completely described below in conjunction with the other embodiments and accompanying drawings, and to fully understand the purpose, features and effects of the present disclosure. Apparently, the described embodiments are only some of the embodiments of the present disclosure, rather than all of them. Based on the embodiments of the present disclosure. The embodiments of the present disclosure are shown in the accompanying drawings. The function of the accompanying drawings is to supplement the description of the text part of the specification with figures, and people can intuitively and visually understand each technical feature and overall embodiments of the present disclosure, but it should not be construed as limiting the protection scope of the present disclosure.

In the description of the present disclosure, it should be understood that the orientation descriptions, such as up, down, front, back, left, right, etc. indicated orientations or positional relationships are based on the orientations or positional relationships shown in the drawings, and are only in order to facilitate the description of the present disclosure and simplify the description, it does not indicate or imply that the device or element referred to must have a specific orientation, be constructed and operated in a specific orientation, and thus should not be construed as limiting the present disclosure.

In the description of the present disclosure, several means one or more, and multiple means more than two. Greater than, less than, exceeding, etc. are understood as not including the original number, and above, below, within, etc. are understood as including the original number. The description of the first and second is only for the purpose of distinguishing the features, it cannot be understood as indicating or implying the relative importance or implicitly indicating the number of the indicated features or implicitly indicating the order of the indicated features relation.

In the description of the present disclosure, unless otherwise clearly defined, words such as configuration, installation, and connection should be understood in a broad sense, and may determine the specific meanings of the above words in the present disclosure in combination with the specific content of the embodiments. At the same time, each embodiment in the present disclosure can be combined interactively on the premise of not conflicting with each other.

Figure 2:
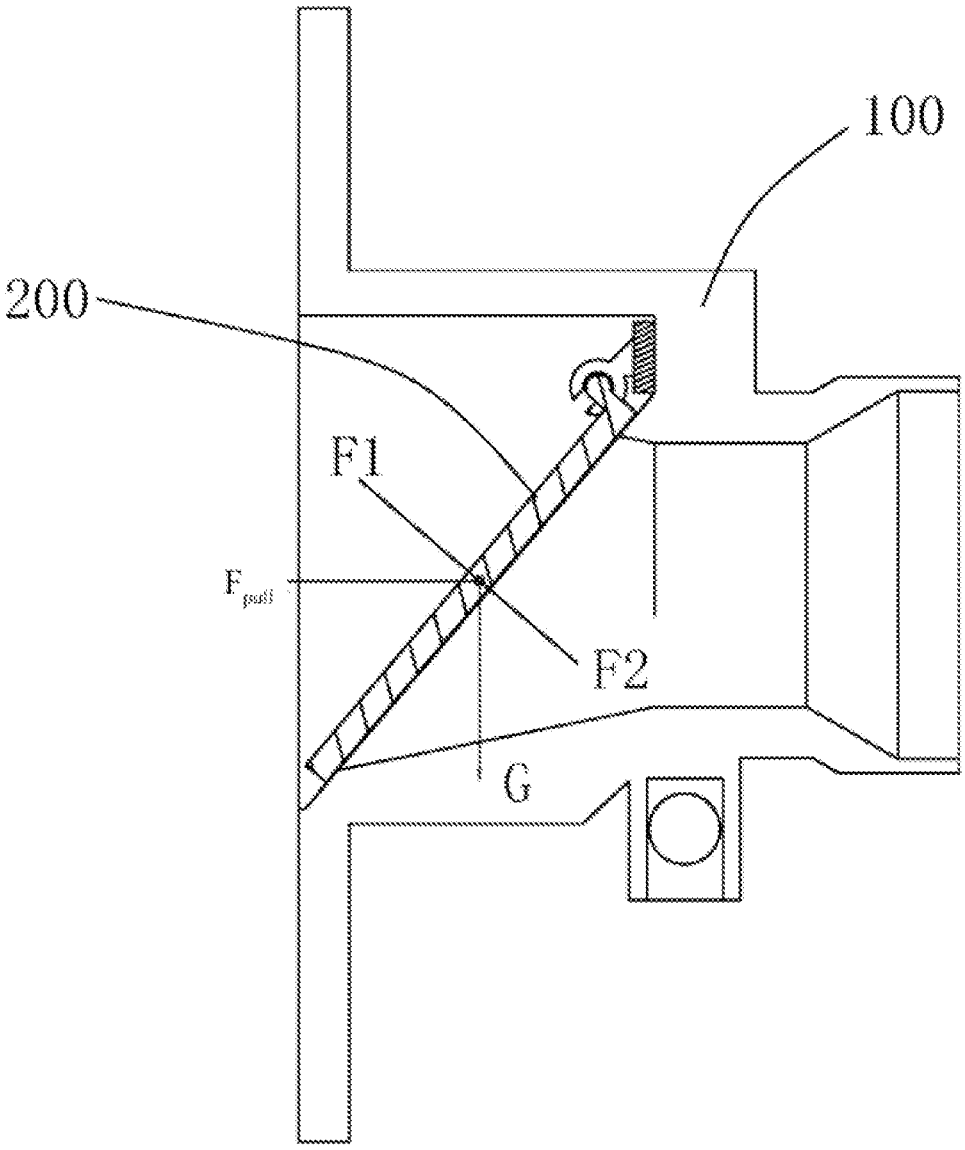
FIG. 2 is a force analysis view of the first embodiment of the present disclosure.
Figure 3:
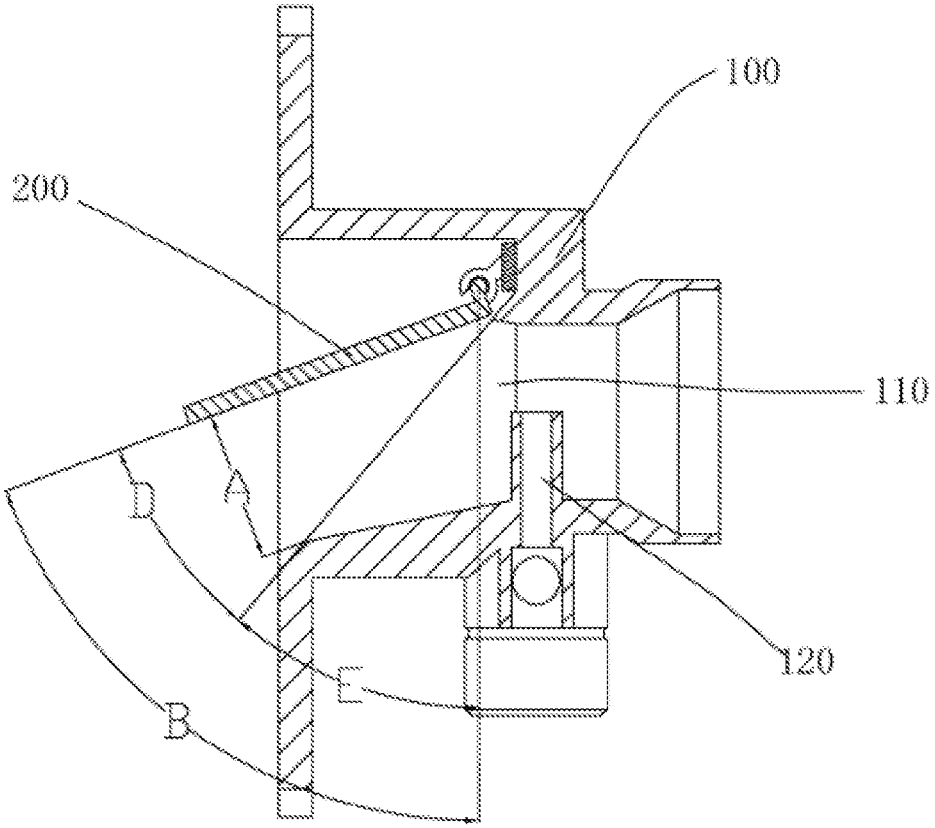
FIG. 3 is a schematic view of the first embodiment of the present disclosure in a working state.

In one embodiment, referring to FIGS. 1 to 3, an anti-backflow premixer includes a housing 100, in which a premixing chamber 110 is provided. The premixing chamber 110 includes a constriction section 101, a throat 102, and a diffusion section 103 arranged sequentially from rear to front. The diffusion section 103 includes an air outlet passage. A baffle 200 is provided in the diffusion section 103 of the premixing chamber 110. The baffle 200 is inclined downward from the back to the front. An upper end of the baffle 200 is hinged to an inner surface of the housing 100, the diffuser section 103 is provided with a shoulder, the shoulder is provided with an inclined platform surface. The baffle 200 has a first position and a second position, and the baffle 200 is capable of moving continuously between the first position and the second position. When the baffle 200 is located at the first position, the baffle 200 abuts against the platform surface and completely blocks the diffusion section 103, that is, the air outlet passage of the premixing chamber 110 is blocked. When the baffle 200 moves from the first position to the second position, an opening of the air outlet passage gradually increases. A gas channel 120 is provided in the throat 102, and the gas channel 120 is in communication with the premixing chamber 110.

When in use, the anti-backflow premixer is mounted in the water heater. When the water heater is not working, since the baffle 200 is inclinedly arranged, it is always kept at the first position under its own gravity, to block the diffusion section 103, effectively preventing a cold air from flowing back into the heat exchanger in the water heater and causing damage, and also preventing high-temperature flue gas from flowing back into a fan and the water heater, protecting a normal use of the product, increasing its service life and greatly improving product safety. When the water heater is working, since the fan is provided in the water heater, a pressure difference will be generated between a front and a rear of the premixer when the fan starts, the pressure difference will cause air to pass through the premixer from rear to front. When the air passes through the premixing chamber 110 from rear to front, the premixing chamber 110 has a structure similar to a venturi tube. Since the air passes through the constriction section 101, the throat 102, and the diffusion section 103 successively, after the air and gas pass through the throat 102 of the premixing chamber, different pressure differences and flow velocity differences will be generated at front and rear sides of the throat 102. The throat 102 with reduced cross section is located between an inlet and an outlet. According to a formula gas flow Q=air velocity V*cross-sectional area S, the air velocity V2=V1*S1/S2 in the throat 102, the air velocity V will vary with the cross-sectional area S.

A principle of the baffle 200 automatically adjusting a thermal load under an action of the fan:

Referring to FIG. 2 and FIG. 3, when the fan is working, a forward pulling force F is generated on the baffle, the pulling force P decomposes into a pulling force F1, and the baffle 200 is subjected to a downward gravity G under the action of its own weight, the gravity G decomposes into a pressure F2, if the fan sucks the baffle 200 to rotate and open, F1*L>F2*L (for easy comparison, a distance from the two forces to a center of rotation is the same as L), F1=$F_{pull}$*COSB, F2=G*SINB, G=mg, $F_{pull}$=$P_{suction}$*$S_{block}$, (in the formula, $P_{suction}$ is a wind pressure that the fan acts on the baffle after the fan is started, $S_{block}$ is an area of the baffle).

The formula becomes: $P_{suction}$*$S_{block}$*COSB>mg*SINB.

The condition that the baffle stops at a position: $P_{suction}$*$S_{block}$*COSB=Mg*SINB, an amount of gas and air sucked by an amount of the thermal load, a gas flow of the mixed gas $Q=\mu A\sqrt{2gP_{suction}}$.

Referring to FIG. 3, the opening A between the baffle and a plane of the gas mixing chamber is proportional to an angle D between the baffle and the plane of the gas mixing chamber, B is an angle between the baffle and a vertical line, E is an angle between the plane of the gas mixing chamber and the vertical line, B=D+E. When a speed of the fan increases, a value of $P_{suction}$ increases, the opening A between the baffle and the plane of the gas mixing chamber increases, the air flow Q of the mixed gas increases, and the thermal load increases.

Referring to FIG. 1, further as one embodiment, a cover plate 300 is further provided in the premixing chamber 110. The cover plate 300 is inclined downward from the back to the front, an upper end of the cover plate 300 is hinged to the inner surface of the housing 100. The cover plate 300 covers the gas channel 120 under the action of its own weight. A gas outlet of the gas channel 120 is covered by the cover plate 300 when the baffle 200 is not opened, and the gas cannot be discharged, and to eliminate a risk of direct gas discharge due to mis-operation or failure of the gas valve, and improve product safety. The cover plate 300 also utilizes its own gravity to block the gas channel 120. Similarly, when working, the baffle 200 and the cover plate 300 are subject to the action of the fan of the water heater, and the cover plate 300 can be flipped upwards to open.

The cover plate 300 also utilizes its own gravity to block the gas channel 120. Similarly, when working, the baffle 200 and the cover plate 300 are all received by the fan of the water heater, and the cover plate 300 can be turned upwards to open.

Figure 4:
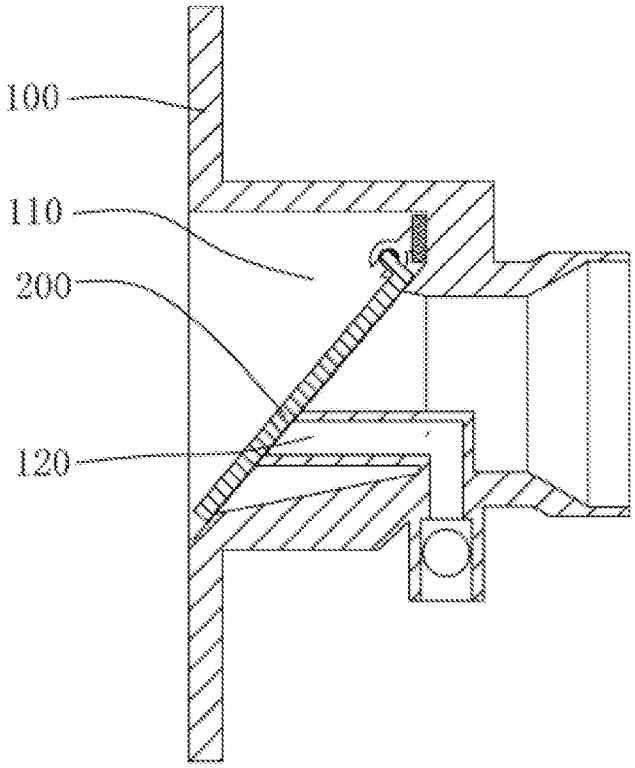
FIG. 4 is a schematic view of a second embodiment of the present disclosure.

Referring to FIG. 4, as different from the first embodiment, the gas outlet of the gas channel 120 is horizontally forward, and the gas outlet is an inclined plane, which is coplanar with the platform surface of the shoulder. Therefore, when the baffle 200 is located at the first position, the gas outlet abuts against the baffle 200.

In order to block the gas outlet, a cover plate is added in the first embodiment, while in this embodiment, a position of the gas outlet is arranged and where the baffle 200 can block the gas outlet and the premixing chamber 110 at the same time.

Figure 5:
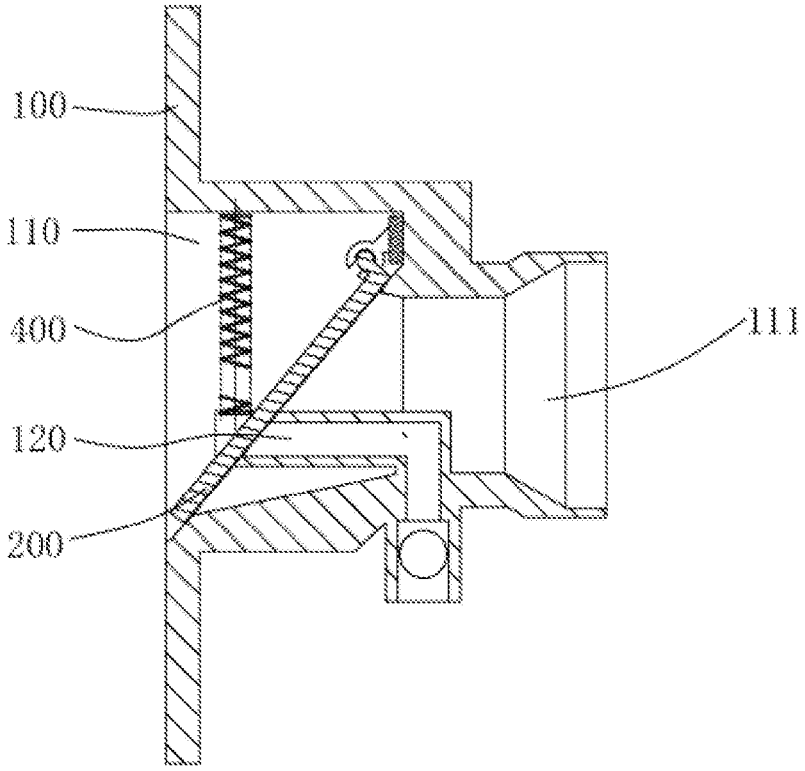
FIG. 5 is a schematic view of a third embodiment of the present disclosure.

Referring to FIG. 5, in this embodiment, a resilient element 400 (e.g., a compression spring) is added. One end of the resilient element 400 abuts against the baffle 200, and the other end of the resilient element 400 abuts against the housing 100. The resilient element 400 forces the baffle 200 to move toward the first position. In one embodiment, an arrangement of the resilient element 400 shown in FIG. 5 is only for illustration.

The difference from the first embodiment is that the baffle 200 of the first embodiment is closed by its own gravity, while this embodiment uses an elasticity of the resilient element 400. The premixer in the first embodiment is blocked by gravity, so a mounting direction is limited and must be mounted vertically. However, after adding the resilient element, the mounting of the premixer is more flexible and no longer subject to gravity restrictions, it is more convenient to use. The baffle 200 is affected by the elasticity, the baffle 200 is jointly acted by the elasticity and a fan suction force, which can ensure that the baffle 200 seals the plane of the gas mixing chamber and the gas outlet with a sealing force, but it will not be too large to be difficult to open, improving product safety and adaptability.

In one embodiment, a threaded element can be provided in the housing, which may be a bolt, etc. The threaded element is threadedly connected to the housing, one end of the threaded element abuts against the compression spring. The threaded element is moved in the housing by rotating the threaded element, an initial position of the threaded element can be adjusted, that is, the precompression force of the resilient element cam be adjusted, to adjust an opening force of the baffle. For example, if the threaded element moves inward, the resilient element will be compressed further, and the opening force of the baffle will increase. Conversely, when the threaded member moves outward, the resilient element is released, and the baffle is more easily to be opened.

Figure 6:
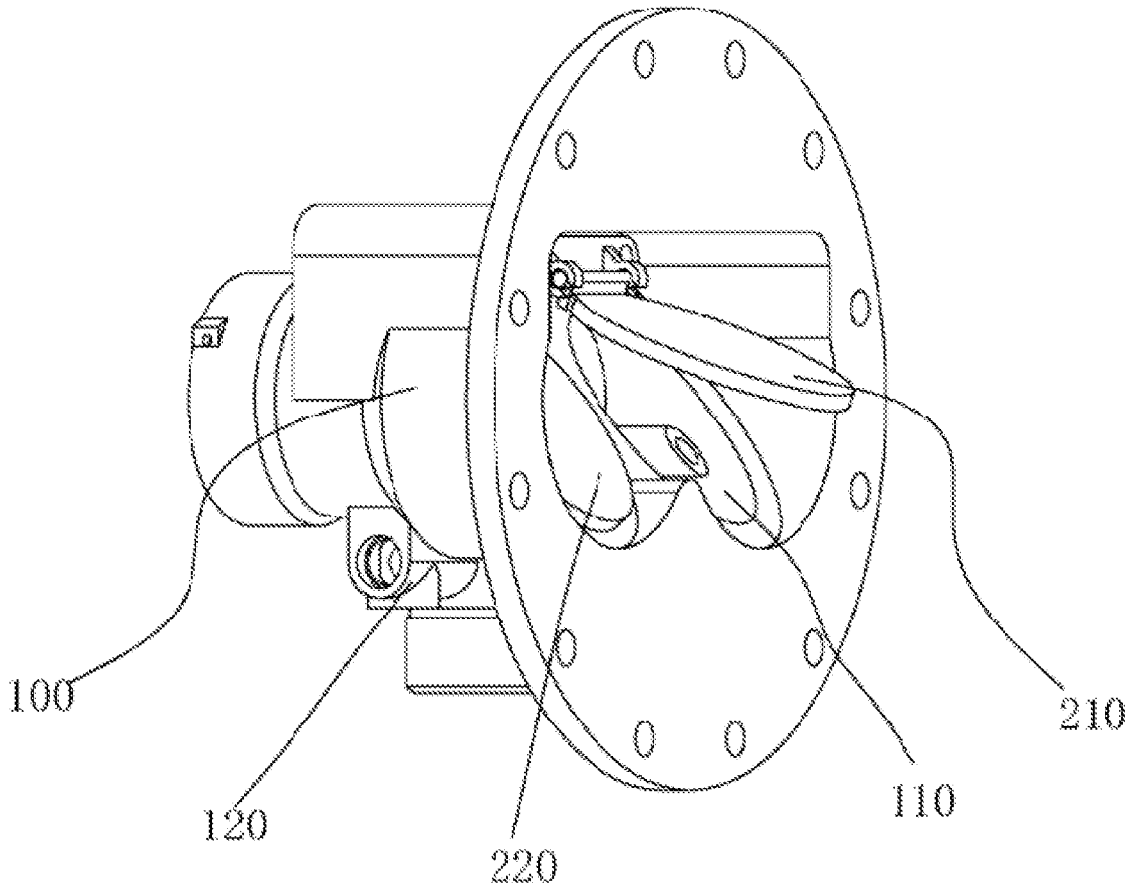
FIG. 6 is a perspective view of a fourth embodiment of the present disclosure.
Figure 7:
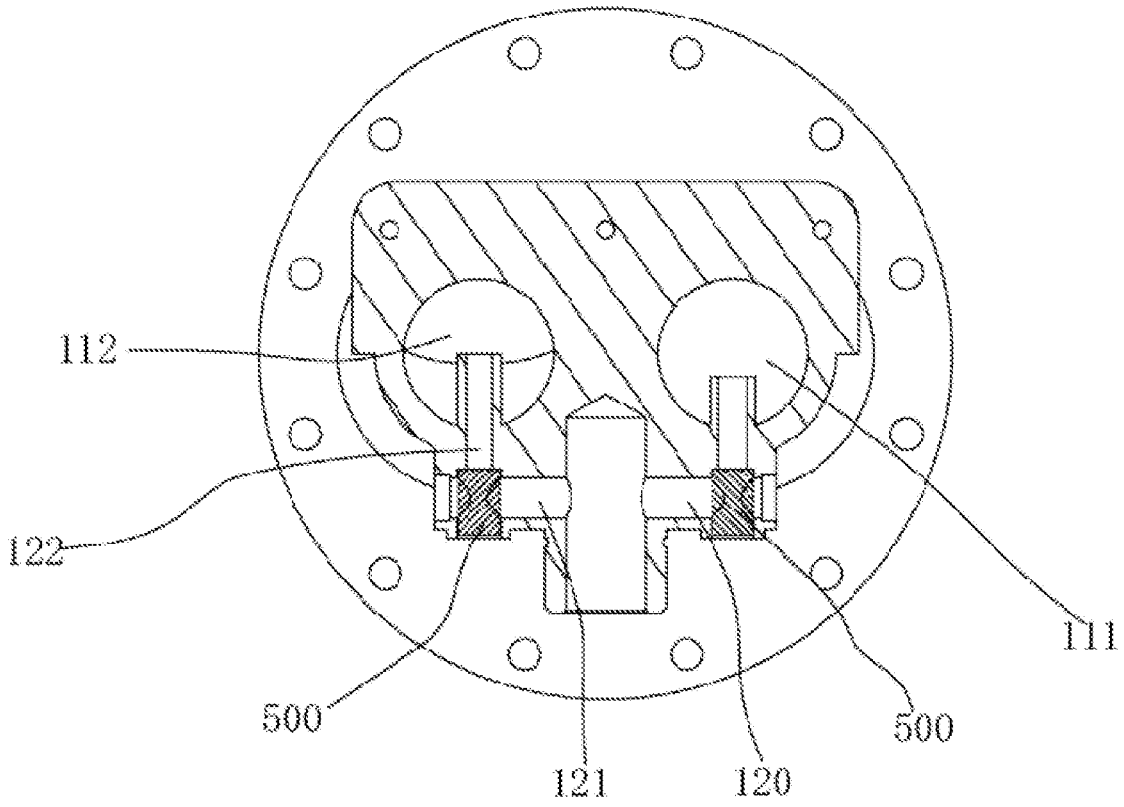
FIG. 7 is a schematic view of the fourth embodiment of the present disclosure.
Figure 8:
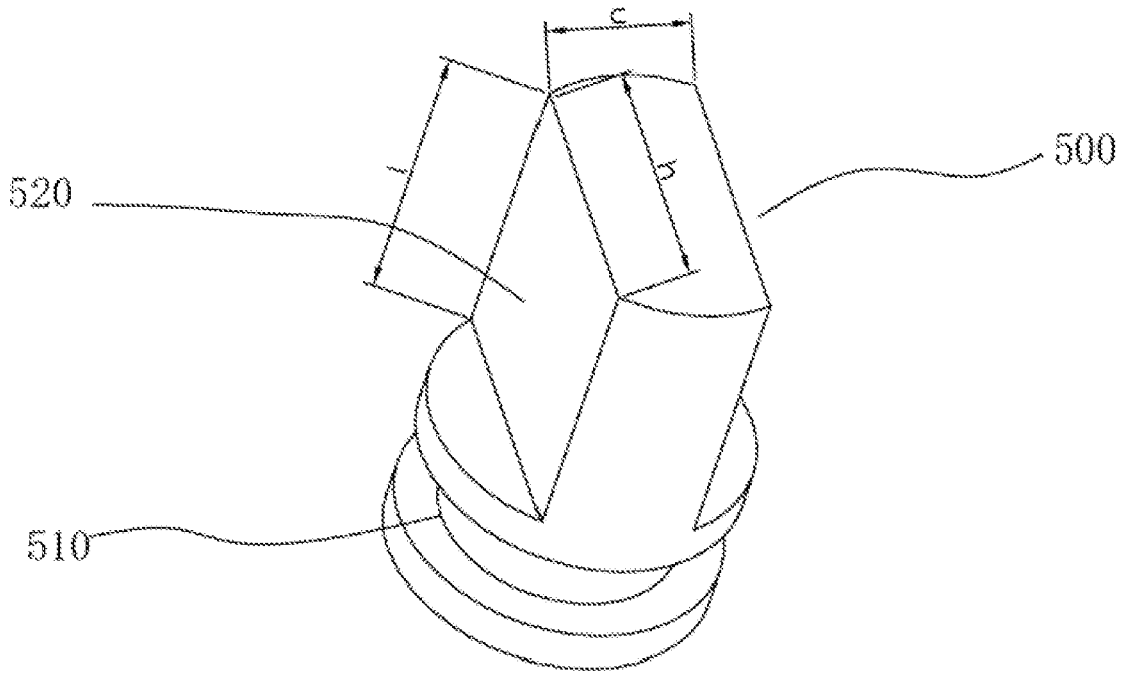
FIG. 8 is a perspective view of an adjusting device of the present disclosure.

Referring to FIG. 6 to FIG. 8, on the basis of the premixer of the first embodiment, two premixing chambers 110 are provided, the two premixing chambers 110 are arranged side by side, and both of the premixing chambers 110 are venturi tubes. Both of the premixing chambers 110 are provided with the baffles 200. The two premixing chambers 110 arranged side by side have gas outlets. When working, at the same fan speed, an adjustment range of product's thermal load can be increased, a range of temperature adjustment can be increased, a comfort of the product can be improved, especially for the product with a heavy load. In one embodiment, both of the premixing chambers 110 are of venturi tube structures, and the air and the gas are more uniformly mixed.

Further as one embodiment, the two premixing chambers 110 are respectively a first premixing chamber 111 and a second premixing chamber 112. A minimum cross-sectional area of the first premixing chamber 111 is greater than that of the second premixing chamber 112. The minimum cross-sectional areas of the two premixing chambers 110 are not the same, and sizes of the two corresponding gas outlets are not the same, which can increase the adjustment range of product's thermal load, increase the range of temperature adjustment, improve the comfort of the product, and save more gas. Of course, in some embodiments, the minimum cross-sectional areas of the two premixing chambers can be the same, the sizes of the two corresponding gas outlets are also the same, which is conducive to simple production and prevents errors.

Further as in one embodiment, the two baffles 200 are respectively a first baffle 210 and a second baffle 220, the first baffle 210 is mounted in the first premixing chamber 111, the second baffle 220 is mounted in the second premixing chamber 112, and a driven force of the first baffle 210 is greater than that of the second baffle 220.

The driven force is equivalent to the opening force of the baffle, the two baffles with different driven forces will have inconsistent openings under the suction of the same fan speed, which can increase the adjustment range of the product's thermal load and the range of temperature adjustment, improve the comfort of the product, especially for the product with the heavy load.

From a force analysis above, it can be seen that if the fan sucks the baffle to rotate and open, $F_{pull}*L>F_{pressure}*L$ (for easy comparison, the distance from the two forces to the center of rotation is the same as L), $F_{pull}=P_{suction}*COSB$, $F_{pressure}=G*SINB$, $G=mg$, $F_{suction}=P_{suction}*S_{block}$.

The formula becomes: $P_{suction}*S_{block}*COSB>mg*SINB$.

When the fan speed increases, the value of $P_{suction}$ increases. When the speed of the fan is constant, the value of $P_{suction}$ is constant. The greater a force-bearing area S of the baffle, the greater the value of $S_{block}$. When the baffle is constant, the value of $S_{block}$ is constant. The baffle completely seals the air-mixing cavity plane in contact with it. The smaller a value of an acute angle B between the plane of the gas mixing chamber that the baffle completely seals and the vertical line, the greater the value of COSB. The smaller the initial value of the acute angle B, the greater the $F_{pull}$, and the baffle can then be easily turned to open. The acute angle B is the angle between the baffle and the vertical line.

On the other hand, the smaller a mass m of the baffle, the smaller the $F_{pressure}$, the smaller the value of the acute angle B between the plane of the gas mixing chamber that the baffle completely seals and the vertical line, the smaller the value of SINB, the smaller value of the $F_{pressure}$, and the baffle can then be easily turned to open.

For the baffles 200 in the two premixing chambers 110, when one of the baffles has a small mass m, or the force-bearing area S of the baffle is great, or the value of the acute angle B is small, its driven force is small, and it will be opened first, the other one will not be opened, thus forming a segmented intake combustion, which can increase the adjustment range of the product's thermal load, increase the range of the temperature adjustment, and improve the comfort of the product, especially for the product with the heavy load. However, the value of the acute angle B cannot be configured too small. If the value of the acute angle B is configured too small, the value of $F_{pressure}$ is too small and the baffle is easy to open. For example, the plane of one air mixing chamber is configured at 20 degrees, the plane of the other air mixing chamber is configured at 40 degrees, SIN40/SIN20=1.879, a difference between the gravity components of the two is approximately 2 times, which effectively improves an adjustment ratio of the product's thermal load.

Referring to FIG. 7 to FIG. 10-C, as a further in one embodiment, an adjusting device 500 is provided in the gas channel 120, the adjusting device 500 is configured to adjust a minimum flow area of the gas channel 120.

Further as in one embodiment, the adjusting device 500 includes a connecting portion 510 and an adjusting portion 520 connected to each other. The connecting portion 510 is provided on a peripheral wall of the gas channel 120 and is rotatably connected to the housing 100. The adjusting portion 520 is at least partially located in the gas channel 120, the adjusting portion 520 changes the minimum flow area of the gas channel 120 with a rotation of the connecting portion 510.

Figure 9:
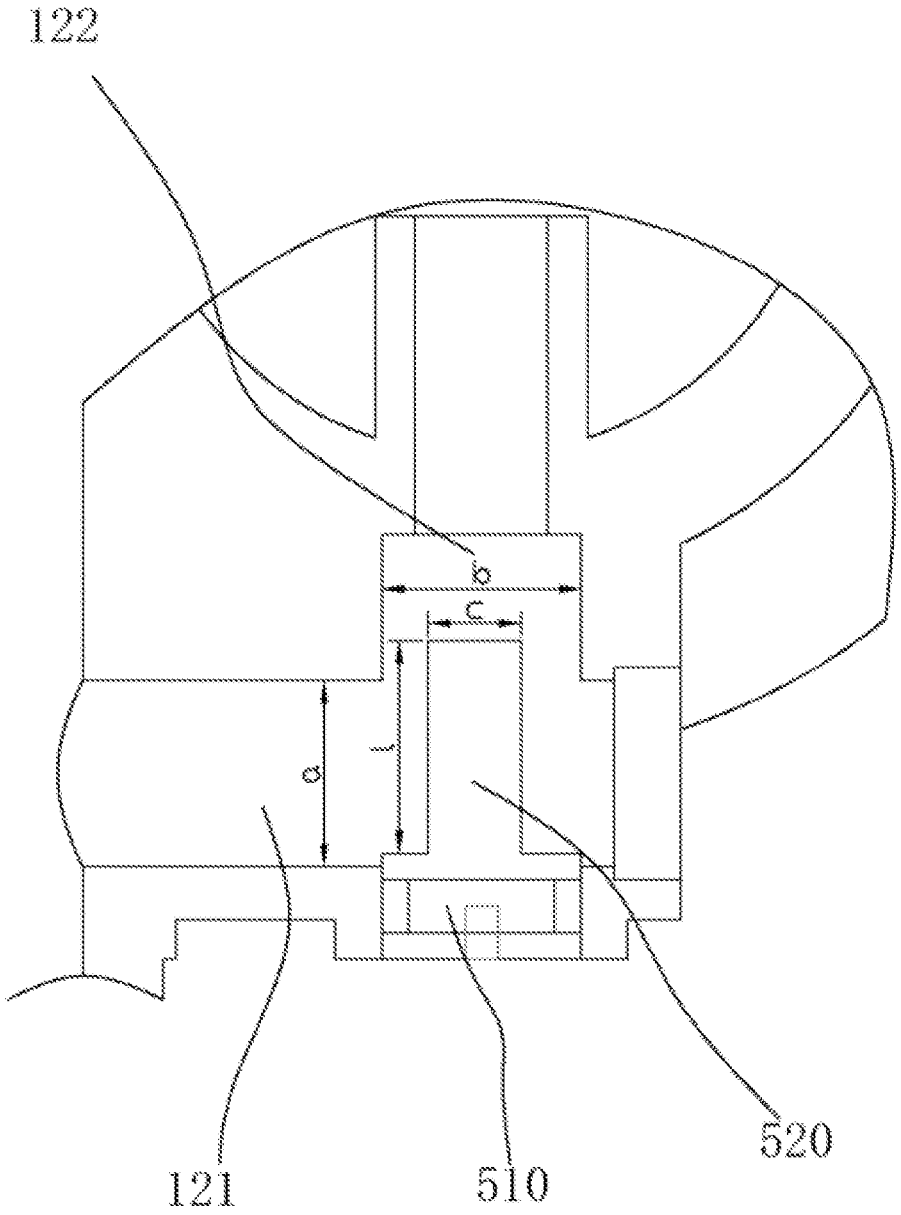
FIG. 9 is a schematic view of the adjusting device of the present disclosure in installation.

Referring to FIG. 7 and FIG. 9, further as in one embodiment, the gas channel 120 includes a first adjusting section 121 and a second adjusting section 122 that are connected in series in sequence, and the first adjusting section 121 and the second adjusting section 122 are perpendicular to each other. The connecting portion 510 is provided on a peripheral wall of the first adjusting section 121 and is rotatably connected to the housing 110, the adjusting portion 520 is inserted into the second adjusting section 122, the two adjusting devices 500 located in the two gas channels 120 are arranged side by side.

Referring to FIG. 8 and FIG. 9, further as in one embodiment, the gas channel 120 is shaped as a circular tube. A pipe diameter of the first adjusting section 121 is defined as a, a pipe diameter of the second adjusting section 122 is defined as b. The adjusting portion 520 is located at a junction of the first adjusting section 121 and the second adjusting section 122. A center line of the connecting portion 510 coincides with a center line of the second adjusting section 122. The adjusting portion 520 is block-shaped, a length of the adjusting portion 520 is defined as 1, a width is defined as is h, a thickness is defined as c, the adjusting portion 520 is eccentrically located on the connecting portion 510. The adjusting portion 520 is inserted into the second adjusting section 122, and the thickness c of the adjusting portion 520 is less than the pipe diameter b of the second adjusting section 122 and the pipe diameter a of the first adjusting section 121, and the length of the adjusting portion 5201 is greater than the pipe diameter a of the first adjusting section 121, the width h of the adjusting portion 520 is substantially equal to the pipe diameter a of the first adjusting section 121.

Referring to FIG. 9 and FIG. 10A, at this time, the connecting portion 510 is located at a position of 0°, or the first position. The adjusting portion 520 limits the minimum flow area of the gas channel 120 as $S_1$.

Referring to FIG. 10-B, when the connecting portion 510 is rotated to be located at a position of 90°, or the second position, the adjusting portion 520 limits the minimum flow area of the gas channel 120 as $S_2$.

Referring to FIG. 10-C, when the connecting portion 510 is rotated further to be located at a position of 180°, or the third position, the adjusting portion 520 limits the minimum flow area of the gas channel 120 as $S_3$.

Since the adjusting portion 520 is eccentrically arranged with the connecting portion 510, in the first position and the third position, although the adjusting portion 520 is relatively perpendicular to the first adjusting section 121, its position relative to the second adjusting section 122 is different, and the minimum flow area of the gas channel 120 is different. When the connecting portion 510 is in the second position, the adjusting portion 520 is relatively parallel to the first adjusting section 121, the minimum flow area of the gas channel 120 is a cross-sectional area of the second adjusting section 122 minus a transverse cross-sectional area of the adjusting portion 520.

It can be seen that, when the connecting portion 510 is in three different positions, it can correspond to the minimum flow areas of the three different gas channels 120, a precise matching of three different gas sources can be completed by ingeniously configuring the corresponding sizes. A convenience of adjustment is improved.

As a further in one embodiment, the adjusting device 500 further includes an electric adjustment portion, which is configured to controllably to drive the connecting portion 510, and/or, the adjusting device 500 further includes a manual adjustment portion, which is at least partially exposed outside the housing, the manual adjustment portion is configured to drive the connecting portion 510.

What is claimed is:

1. An anti-backflow pre-mixer, comprising:

a housing provided with a premixing chamber that extends through the housing, the premixing chamber comprising an air outlet passage;

a baffle connected to the housing, wherein the baffle has a first position and a second position, and the baffle is capable of moving continuously between the first position and the second position, the baffle blocks the air outlet passage of the premix chamber when the baffle is in the first position, when the baffle moves from the first position to the second position, an opening of the air outlet passage gradually increases; and a gas channel being in communication with the premixing chamber, wherein two premixing chambers are provided, the two premixing chambers are arranged side by side left and right, both of the premixing chambers are venturi tubes, and both of the premixing chambers are provided with the baffles, wherein the gas channel is provided with an adjusting device, and the adjusting device is configured to adjust a minimum flow area of the gas channel, wherein the adjusting device comprises a connecting portion and an adjusting portion connected to each other, the connecting portion is located on a peripheral wall of the gas channel and is rotatably connected to the housing, the adjusting portion is at least partially located in the gas channel, and the adjusting portion changes the minimum flow area of the gas channel with a rotation of the connecting portion wherein the gas channel comprises a first adjusting section and a second adjusting section that are connected in series in sequence, the first adjusting section and the second adjusting section are perpendicular to each other, the connecting portion is provided on a peripheral wall of the first adjusting section and is rotatably connected to the housing, and the adjusting portion is inserted into the second adjusting section, and wherein the gas channel is shaped as a circular tube, the adjusting portion is located at a junction of the first adjusting section and the second adjusting section, the adjusting portion is block-shaped, a cross-sectional area of the adjusting portion is adapted to a pipe diameter of the second adjusting section, and the adjusting portion is arranged eccentrically on the connecting portion.

2. The anti-backflow pre-mixer according to claim 1, wherein the baffle blocks the air outlet passage using its own gravity, the housing is provided with an inclined platform surface on a peripheral wall of the premixing chamber, when the baffle is in the first position, one end of the baffle is hinged to the housing, and the other end thereof is inclined downward and abuts against the platform surface.

3. The anti-backflow pre-mixer according to claim 1, wherein one end of the baffle is hinged to the housing, a resilient element is provided between the baffle and the housing, the resilient element exerts a force to the baffle to move to the first position.

4. The anti-backflow pre-mixer according to claim 3, wherein the resilient element is a compression spring, one end of the resilient element is adjustable connected to the housing, and the other end thereof abuts against the baffle.

5. The anti-backflow pre-mixer according to claim 1, wherein the premixing chamber is further provided with a cover plate, the cover plate is inclined downward from rear to front, an upper end of the cover plate is hinged to an inner surface of the housing, the cover plate covers the gas channel under an action of its own weight.

6. The anti-backflow pre-mixer according to claim 1, wherein the gas channel comprises a gas outlet facing an air inlet direction of the premixing chamber, when the baffle is in the first position, the gas outlet abuts against the baffle.

7. The anti-backflow pre-mixer according to claim 1, wherein the two premixing chambers are respectively a first premixing chamber and a second premixing chamber, a minimum cross-sectional area of the first premixing chamber is greater than a minimum cross-sectional area of the second premixing chamber.

8. The anti-backflow pre-mixer according to claim 7, wherein the baffle includes a first baffle and a second baffle, the first baffle is mounted in the first premixing chamber, the second baffle is mounted in the second premixing chamber, a driven force of the first baffle is greater than a driven force of the second baffle when moving from the first position to the second position.

9. The anti-backflow pre-mixer according to claim 1, wherein the adjusting device further comprises an electric adjustment portion, the electric adjusting portion is configured to controllably drive the connecting portion.

10. A gas water heater, comprising the anti-backflow pre-mixer according to claim 1.

11. The anti-backflow pre-mixer according to claim 1, wherein the adjusting device further comprises a manual adjustment portion, the manual adjustment portion is at least partially exposed outside the housing, the manual adjusting portion is configured to drive the connecting portion.

* * * * *